US009763511B2

(12) United States Patent
Nakamura et al.

(10) Patent No.: US 9,763,511 B2
(45) Date of Patent: Sep. 19, 2017

(54) COSMETIC APPLICATOR

(71) Applicant: Taiki Corp., Ltd., Osaka-shi, Osaka (JP)

(72) Inventors: Koji Nakamura, Osaka (JP); Makoto Someya, Tokyo (JP)

(73) Assignee: Taiki Corp., Ltd., Osaka (JP)

( * ) Notice: Subject to any disclaimer, the term of this patent is extended or adjusted under 35 U.S.C. 154(b) by 130 days.

(21) Appl. No.: 14/353,006

(22) PCT Filed: Oct. 12, 2012

(86) PCT No.: PCT/JP2012/076398
§ 371 (c)(1),
(2) Date: Apr. 18, 2014

(87) PCT Pub. No.: WO2013/058176
PCT Pub. Date: Apr. 25, 2013

(65) Prior Publication Data

US 2014/0325775 A1 Nov. 6, 2014

(30) Foreign Application Priority Data

Oct. 20, 2011 (JP) ..... 2011-230727

(51) Int. Cl.
*A46B 9/02* (2006.01)
*A46B 3/10* (2006.01)
*A45D 33/36* (2006.01)

(52) U.S. Cl.
CPC ..... *A46B 9/021* (2013.01); *A45D 33/36* (2013.01); *A46B 3/10* (2013.01); *A46B 9/028* (2013.01);
(Continued)

(58) Field of Classification Search
CPC .. Y10S 15/05; A46B 3/00; A46B 3/02; A46B 3/04; A46B 3/08; A46B 3/10; A46B 3/12;
(Continued)

(56) References Cited

U.S. PATENT DOCUMENTS 39,439 A * 8/1863 Whiting ..... 15/204
66,475 A * 7/1867 Drayton ..... 15/204
(Continued)

FOREIGN PATENT DOCUMENTS

CH 114670 * 4/1926
JP 12-17609 Y1 11/1937
(Continued)

OTHER PUBLICATIONS

Microfilm of the specification and drawings annexed to the request of Japanese Utility Model Application No. 180260/1982 (Laid-open No. 85111/1984).
(Continued)

*Primary Examiner* — Mark Spisich
(74) *Attorney, Agent, or Firm* — Knobbe, Martens, Olson & Bear LLP

(57) ABSTRACT

A cosmetic applicator includes a handle part and a brush part made of bristle materials planted in the handle part and is used to apply a powdery cosmetic containing a fine powder, wherein such cosmetic applicator is characterized in that the bristle materials are planted in the ring-shaped part formed between the interior surface of the handle part and the exterior surface of the core provided in the handle part, and the bristle materials of the brush part extend upward from the handle part and their tips form an outer periphery having a horizontal shape relative to the handle part, while forming a shape gradually concaving from the outer periphery toward the center axis of the brush part.

10 Claims, 3 Drawing Sheets

(52) U.S. Cl.
CPC ..... *A46B 2200/1046* (2013.01); *Y10S 15/05* (2013.01)

(58) Field of Classification Search
CPC .... A46B 3/16; A46B 9/00; A46B 9/02; A46B 9/021; A46B 9/028; A46B 2200/1046; A46B 2200/1053; A46B 2200/106; A46B 2200/1033; A45D 27/04; A45D 33/36; A45D 34/042; A45D 34/045; A45D 2200/10
USPC ... 15/160, 167.3, 191.1, 192, 193, 204, 205, 15/DIG. 5; 132/313, 317, 320
See application file for complete search history.

(56) References Cited

U.S. PATENT DOCUMENTS

| | | | | | |
|---|---|---|---|---|---|
| 110,628 | A * | 1/1871 | Burtnett | 15/204 | |
| 116,382 | A * | 6/1871 | Whiting | 15/204 | |
| 185,256 | A * | 12/1876 | Perrin | 15/204 | |
| 307,711 | A * | 11/1884 | Fish | 15/169 | |
| 819,934 | A * | 5/1906 | Schreiner | 15/204 | |
| 928,550 | A * | 7/1909 | Schwartz | 15/204 | |
| 1,120,476 | A * | 12/1914 | Hansen | A46B 15/00 | 15/104.94 |
| 1,153,118 | A * | 9/1915 | Kimes | 15/204 | |
| 1,297,944 | A * | 3/1919 | Wallace | A46B 3/18 | 15/205 |
| 1,300,012 | A * | 4/1919 | Purdy | 15/204 | |
| 1,694,364 | A * | 12/1928 | Albright | A46B 15/00 | 15/159.1 |
| 1,706,058 | A * | 3/1929 | Ebert | A46B 11/08 | 15/204 |
| 1,749,309 | A * | 3/1930 | Sigmund | A46B 15/00 | 15/191.1 |
| 4,842,132 | A * | 6/1989 | Wells | A46B 17/04 | 132/313 |
| 4,944,625 | A | 7/1990 | Futter et al. | | |
| 2002/0124336 | A1 * | 9/2002 | Henrie | A46B 9/02 | 15/106 |

FOREIGN PATENT DOCUMENTS

| | | | |
|---|---|---|---|
| JP | 59-85111 | U | 6/1984 |
| JP | 02-156902 | A | 6/1990 |
| JP | 10-295441 | A | 11/1998 |
| JP | 2006-069902 | A | 3/2006 |
| JP | 2006-265214 | A | 10/2006 |
| JP | 2008-220880 | A | 9/2008 |

OTHER PUBLICATIONS

International Search Report issued by Japan Patent Office on Dec. 18, 2012 in the corresponding PCT patent application No. PCT/JP2012/076398.

* cited by examiner

[Fig. 1]
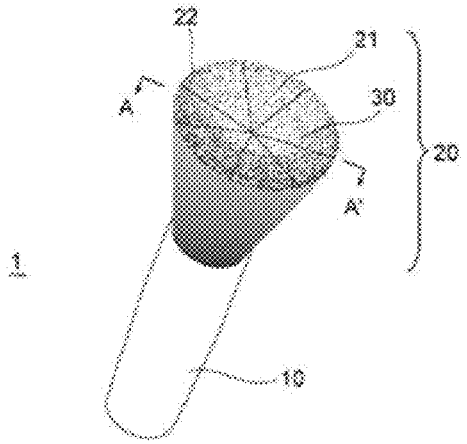
[Fig. 2]
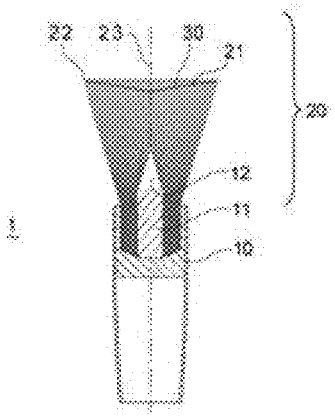
[Fig. 3A]
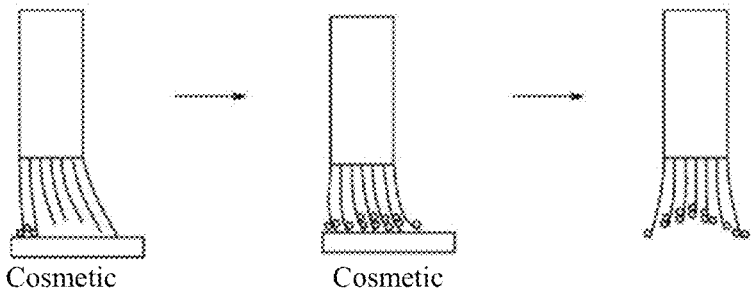
[Fig. 3B]
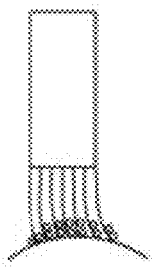

[Fig. 4]
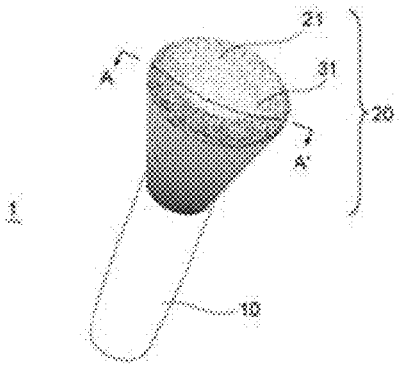
[Fig. 5]
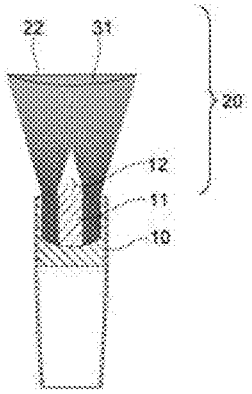
[Fig. 6]
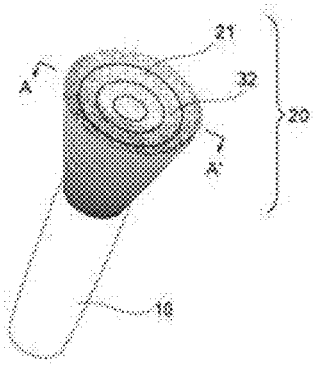
[Fig. 7]
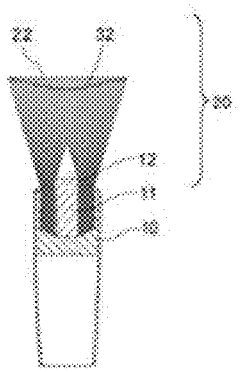

[Fig. 8]
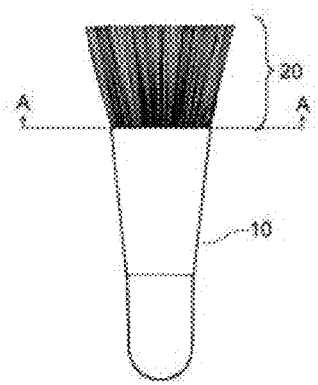
[Fig. 9]
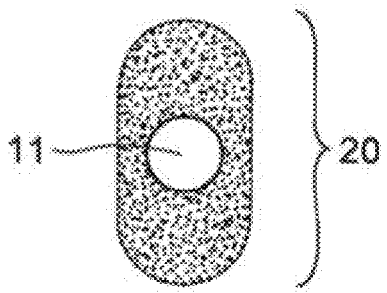
[Fig. 10]
Background Art
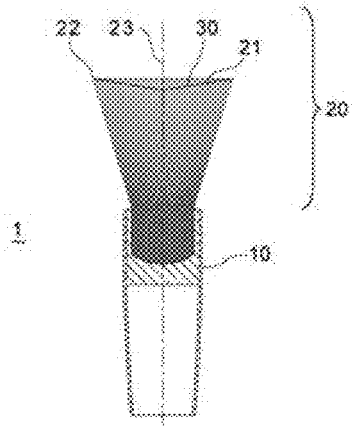

COSMETIC APPLICATOR

This application is the U.S. National Phase under 35 U.S.C. §371 of International Application PCT/JP2012/076398, filed Oct. 12, 2012, which claims priority to Japanese Patent Application No. 2011-230727, filed Oct. 20, 2011. The International Application was published under PCT Article 21(2) in a language other than English.

TECHNICAL FIELD

The present invention relates to a cosmetic applicator for applying cosmetics to the face. Specifically, the present invention relates to a cosmetic applicator for applying powdery cosmetics containing fine powders.

BACKGROUND ART

Solid powdery cosmetics formulated by mixing a fine powder of 0.1 to 10 μm in average particle size with an oil-based constituent, etc., have been used in recent years, and although these cosmetics are excellent in terms of how they spread smoothly and adhere to the skin when applied and keep the skin feeling moisturized, their excessively high adhesion property to the skin means the powder attaches precisely along the contours of the skin, thus emphasizing unwanted unevenness of the skin created by lines and pores (refer to Patent Literature 1).

On the other hand, many cosmetic brushes having a convex surface at their tip, designed for use with conventional solid powdery cosmetics of large average particles sizes, are used to apply the aforementioned fine solid powdery cosmetics to the face. Such solid powdery cosmetic of fine average particle size is taken from its container onto such cosmetic brush and then applied to the skin roughly evenly using the brush. When the fine solid powdery cosmetic is taken onto the brush from its container, however, the convex surface at the brush tip prevents the cosmetic from being taken roughly evenly onto the brush tip surface, and consequently the cosmetic is applied to the face in a condition where it has been taken only onto the convex part of the brush. As a result, a large amount of cosmetic is applied in the area where the cosmetic is applied first and smaller amounts are applied in other areas, and since the amount of cosmetic applied varies from one area to another across the face, mottled appearance (thickness differences) may result.

Also when the cosmetic is taken from the container onto the brush, moving the brush back and forth while pressing it against the cosmetic in order to transfer the cosmetic to the brush tends to cause the cosmetic in the convex part to scatter due to the reactive force to this pressure, because the convex part is constituted by closely packed bristle materials and is thus very rigid.

In the meantime, there is a growing interest among users in recreating professionally made-up looks, and a greater need for simple ways to achieve finishes of professional makeup artists, but when the aforementioned cosmetic brush is used for makeup, the cosmetic is applied flatly and unevenly, which leads to problems such as a flat look because areas that should be highlighted do not appear much different from other areas that need not be highlighted, and the face looking heavily made up or powdery. One way to solve these problems is to apply a cosmetic constituted by a sheet-like powder of approx. 50 μm in average particle size, using a cosmetic brush made of brush bristles whose tip has a roughly spherical shape, by moving the brush in one direction while turning it little by little to apply the cosmetic using the resilience of the brush bristles (refer to Patent Literature 3).

In light of the above, a cosmetic applicator is available which comprises a handle part and a brush part made of bristle materials planted in the handle part and which is used to apply a powdery cosmetic containing a fine powder, wherein the bristle materials of the brush part extend upward from the handle part and their tips form an outer periphery having a horizontal shape relative to the handle part, while gradually concaving from the outer periphery toward the center axis of the brush part; however, such cosmetic applicator has a constant bristle material density at the center axis of the brush part and along the outer periphery, and therefore as the cosmetic applicator is used over time, the powdery cosmetic moves to and collects at the center axis of the brush and this part where the cosmetic collects may harden. This may reduce the otherwise good feeling of use (refer to Patent Literature 4).

BACKGROUND ART LITERATURE

Patent Literature

[Patent Literature 1] Japanese Patent Laid-open No. 2006-265214

[Patent Literature 2] Japanese Patent Laid-open No. Hei 10-295441

[Patent Literature 3] Japanese Patent Laid-open No. 2006-69902

[Patent Literature 4] Japanese Patent Laid-open No. 2008-220880

SUMMARY OF THE INVENTION

Problems to be Solved by the Invention

When a solid powdery cosmetic of small average particle size is applied using the cosmetic brush described in Patent Literature 1, the solid powdery cosmetic is applied to the skin with the brush in a condition where the cosmetic has been taken only onto the convex part of the brush and consequently a large amount of cosmetic attaches to the area where the cosmetic is applied first, as mentioned above. As a result, the amount of cosmetic applied differs between the area where the cosmetic is applied first and other areas.

Accordingly, before the cosmetic is applied to the face, the amounts taken onto the bristle materials are equalized by spreading the cosmetic attached to the convex part using a hand, etc. When a fine cosmetic is applied, on the other hand, the fineness of its average particle size tends to cause the cosmetic to attach roughly evenly along the lines extending from beside the wings of the nose down to both ends of the mouth, lines extending radially from the corners of the eyes toward the temples, as well as pores, etc., thereby emphasizing the unevenness of the skin in some areas compared to when a non-fine cosmetic is applied.

This gives rise to a need for skillful application involving moving the brush back and forth many times so that the cosmetic is applied roughly evenly and also any unevenness is less emphasized, and this renders the makeup process very cumbersome and time-consuming, which is a problem.

On the other hand, the cosmetic brush made of brush bristles whose tip has a roughly spherical shape as described in Patent Literature 3 makes the makeup process very cumbersome and time-consuming because the brush must be moved in one direction while turning it little by little to apply the cosmetic using the resilience of the brush bristles, and while unevenness of the skin is emphasized in fewer areas when a cosmetic constituted by a sheet-like powder of approx. 50 μm is applied, it is emphasized when this cosmetic brush is used to apply a fine solid powdery cosmetic, which is a problem.

Furthermore, the powdery cosmetic moves to and collects at the center axis of the cosmetic applicator and, because of the consequent hardening of this part, the otherwise good feeling of use may be reduced.

An object of the present invention is to solve the aforementioned problems, or specifically to provide a better feeling of use, by allowing a fine solid powdery cosmetic to move roughly evenly to the tip surface of the brush part, while preventing the cosmetic from scattering from the brush part, and also by keeping the bristle material density at the tip of the brush low and thereby preventing the brush from hardening.

Furthermore, an object of the present invention is to provide a cosmetic applicator that allows the cosmetic applied to the skin to attach roughly evenly to the skin, while preventing the cosmetic from emphasizing any unevenness of the skin.

Means for Solving the Problems

1. A cosmetic applicator comprising a handle part and a brush part made of bristle materials planted in the handle part and which is used to apply a powdery cosmetic containing a fine powder, wherein such cosmetic applicator is characterized in that the bristle materials are planted in a ring-shaped part formed between an interior surface of the handle part and an exterior surface of a core provided in the handle part, and the bristle materials of the brush part extend upward from the handle part and their tips form an outer periphery having a horizontal shape relative to the handle part, while forming a shape gradually concaving from an outer periphery toward a center axis of the brush part.
2. A cosmetic applicator according to 1, characterized in that the concave shape is an inverse cone.
3. A cosmetic applicator according to 1, characterized in that the concave shape is a curved surface.
4. A cosmetic applicator according to 1, characterized in that the concave shape is a stepped pattern.
5. A cosmetic applicator according to any one of 1 to 4, characterized in that a concave factor of the concave shape is 0.05 to 0.3.
6. A method for manufacturing a cosmetic applicator comprising a handle part and a brush part made of bristle materials planted in a handle part and which is used to apply a cosmetic, wherein such method for manufacturing a cosmetic applicator is characterized in that bristle materials are planted in a ring-shaped part formed between an interior surface of the handle part and an exterior surface of a core provided in the handle part, and a tip surface of the brush part is formed in a shape gradually concaving from an outer periphery of the brush part toward a center axis of the brush part.

Effects of the Invention

The cosmetic applicator proposed by the present invention is formed in a shape gradually concaving from the outer periphery of the brush part toward the center axis of the brush part, and therefore provides: a function to move the cosmetic roughly evenly to the brush tip surface; a function to prevent the cosmetic from scattering; a function to allow the applied cosmetic to attach roughly evenly to the skin; and a function to make any unevenness of the skin less emphasized.

As it provides the aforementioned functions, the cosmetic applicator proposed by the present invention eliminates the need to equalize the amounts of the cosmetic taken onto the bristle materials using a hand, etc., and because all that is needed is to move the cosmetic to the bristle materials and the cosmetic will move roughly evenly to the brush tip surface, the present invention has an excellent effect in that the cosmetic can be applied immediately to the skin.

The present invention has another excellent effect in that the valuable cosmetic can be utilized effectively and that no cleaning is needed, because scattering of the cosmetic from its container can be prevented.

The present invention has yet another excellent effect in that the cosmetic can be applied roughly evenly to the skin by simply moving the brush back and forth multiple times while pressing it against the desired area because the cosmetic has been taken roughly evenly onto the brush part, and at the same time any unevenness of the skin becomes less emphasized and lines, pores, etc., are made less conspicuous, thus allowing a finish of a professional makeup artist to be achieved easily.

Also because the bristle material density at the center axis of the brush part is lower than the bristle material density along the outer periphery, the powdery cosmetic reaching the center axis of the brush part does not remain attached to the bristle materials, but is easily released from the brush part, and therefore the center axis of the brush part will not harden over time with use.

BRIEF DESCRIPTION OF THE DRAWINGS

FIG. 1 Perspective view showing the first embodiment

FIG. 2 Section view of the first embodiment, cut along A-A'

FIG. 3A Schematic drawing showing how the cosmetic applicator in the first embodiment is used to take the cosmetic from its container onto the brush tip surface 21

FIG. 3B Schematic drawing showing how the cosmetic applicator in the first embodiment is used to attach to the skin the cosmetic that has been taken onto the brush tip surface 21

FIG. 4 Perspective view showing the second embodiment

FIG. 5 Section view of the second embodiment, cut along A-A'

FIG. 6 Perspective view showing the third embodiment

FIG. 7 Section view of the third embodiment, cut along A-A'

FIG. 8 Side view of the fourth embodiment

FIG. 9 Section view of the fourth embodiment, cut along A-A'

FIG. 10 Section view of a conventional cosmetic applicator, cut along A-A'

DESCRIPTION OF THE SYMBOLS

1 Cosmetic applicator
10 Handle part
11 Core
12 Space
20 Brush part
21 Brush tip surface
22 Outer periphery
23 Center axis

30 Inverse cone
31 Curved surface
32 Stepped pattern

MODE FOR CARRYING OUT THE INVENTION

Cosmetic applicators conforming to the present invention are explained in detail below by referring to the drawings.

First Embodiment

FIG. 1 is a perspective view showing the first embodiment of a cosmetic applicator 1 pertaining to the present invention. FIG. 2 is a section view of the cosmetic applicator 1 in the first embodiment, cut along plane A-A' as shown in FIG. 1.

As shown in FIGS. 1 and 2, the cosmetic applicator 1 in this embodiment is a cosmetic applicator for applying cosmetics, having a handle part 10 of roughly cylindrical shape and a brush part 20. The tip of the handle part 10 forms a surface cut vertically to a center axis 23 of the handle part 10, and bristle materials are planted on this surface to form the brush part 20. Further, these bristle materials extend from the tip of the handle part 10 in the shape of an inverse cone.

With the cosmetic applicator 1 pertaining to this embodiment, the handle part 10 is not limited to that of roughly cylindrical shape and a handle part of any shape or size can be selected as deemed appropriate so long as it can be gripped easily to apply cosmetics with ease. The same applies to the material constituting the handle part 10, and a handle part made of metal, synthetic resin, wood, etc., can be selected as deemed appropriate or these materials can also be combined as deemed appropriate.

For the bristle materials, animal hairs, synthetic resin hairs, etc., can be used according to the application, and the length and other properties of the bristle materials can also be adjusted as deemed appropriate.

As shown in FIG. 2, the tip surface (surface on the opposite side of one implanted in the handle part 10) of the brush part 20 (hereinafter referred to as a "brush tip surface 21") is formed in the shape of an inverse cone 30 that gradually concaves from an outer periphery 22 of the brush part 20 toward the center axis 23 of the brush part 20. The depth becomes the greatest at the center axis 23. By forming the brush tip surface 21 in this shape, the cosmetic can be taken roughly evenly onto the brush tip surface 21 and scattering of the cosmetic can be prevented.

The concave factor of the inverse cone is preferably approx. 0.05 to approx. 0.3, or more preferably 0.1 to 0.2.

Here, the concave factor is the value expressed by B/A, where A represents the height from the tip of the handle part 10 into which bristle materials are implanted to the outer periphery 22 of the brush part 20, while B represents the height from the outer periphery 22 of the brush part 20 to the deepest part of the concavity.

As long as the concave factor is within the aforementioned ranges, the amount of cosmetic taken onto the brush tip surface can be kept roughly even, while scattering of the cosmetic can be prevented, and the amount attached to the skin can also be kept roughly even.

As shown in FIG. 2, the cosmetic applicator 1 proposed by the present invention has a core 11 whose center axis is the center axis 23 when bristle materials are implanted/fixed onto the handle part 10, and the bristle materials in the handle part 10 are inserted into the ring-shaped part formed between the exterior surface of the core 11 and the interior surface of the handle part 10 and fixed in a manner forming a donut shape around the core 11.

As a result, a space 12 is formed above the handle part 10. This space is formed to accommodate the bristle materials fixed in the ring-shaped space because, as the bristle materials extend from the tip of the handle part 10 in an inverse cone shape, they also expand inside the ring-shaped space. The core 11 must be made of hard material, such as wood, metal or resin, among others.

As shown in FIG. 2, the end of the core 11 may be fixed in a condition projecting toward the brush tip surface from the end of the handle part 10 on which the bristle materials are fixed, or the end of the core 11 may be kept within the end of the handle part 10.

If the end of the core 11 projects from the end of the handle part 10, it serves to support the bristle materials so as to resist flattening even when a force is applied in the direction of flattening the bristle materials during use.

This way, the bristle materials themselves become resilient and are never flattened, thereby achieving a better feeling of use.

If the end of the core 11 is projected toward the brush tip surface with reference to the end of the handle part 10, the extent to which the end of the core 11 is projected can be determined by considering the length and hardness of the bristle materials projecting from the end of the brush part, where this extent is 10 mm or less, or preferably 3 to 10 mm, or more preferably 4 to 7 mm.

FIG. 3A is a schematic drawing showing how the cosmetic is taken from its container onto the brush tip surface 21.

FIG. 3B is a schematic drawing showing how the cosmetic that has been taken onto the brush tip surface 21 is attached to the skin. These schematic drawings are used to explain in detail why the amount of cosmetic taken onto the brush tip surface, and amount of cosmetic attached to the skin, can be kept roughly even, as well as why the cosmetic does not scatter.

As shown in FIG. 3A, when the cosmetic is taken from its container onto the brush tip surface 21 to be applied to the skin using the cosmetic applicator 1 for the first time, the bending of the tip of the bristle material decreases from the outer periphery 22 toward the center axis 23 because the length of the bristle material from the handle part 10 to the brush tip surface 21 is longer along the outer periphery 22 and decreases toward the center axis 23 (refer to the figure on the left). Accordingly, although a large amount of cosmetic is taken onto areas near the outer periphery 22 where the bristle materials are longer and bent more, the cosmetic (denoted by "○" in FIG. 3A) moves to the bristle materials that are shorter and bent less near the center axis 23, from near the outer periphery 22 where the bristle materials are longer and bent more, when the cosmetic applicator 1 is moved back and forth multiple times, and consequently the amount of cosmetic taken up becomes roughly even overall (refer to the center figure and figure on the right).

Next, why the cosmetic does not scatter is explained. When the cosmetic is taken up from its container, the outer periphery 22 of the cosmetic applicator 1 comes in contact with the cosmetic and is pressured, as shown in the figure on the left and the center figure in FIG. 3A. Unlike on any conventional convex brush, the bristle materials along this outer periphery 22 in contact are not concentrated in one location, but structurally dispersed instead, and therefore their rigidity is low. Because of this, moving the cosmetic applicator 1 back and forth while being pressed against the cosmetic will not scatter the cosmetic that has been taken onto the outer periphery 22 because the reactive force to this pressure is small.

On the other hand, as shown in FIG. 3B, as the brush tip surface 21 is gently pressed against the skin to attach to the skin the cosmetic that has been taken onto the brush tip surface 21, the shape of the brush tip surface 21, which is the inverse cone 30, approximates the curve of the face. Accordingly, moving the cosmetic applicator 1 back and forth multiple times causes the brush tip surface 21 to be pressed against the facial skin with a roughly even pressure and allows the cosmetic that has been taken roughly evenly onto the brush tip surface 21 to be attached to the skin roughly evenly, and at the same time the back-and-forth movements of the brush tip surface 21 make the surface roughened by pores, etc., appear roughly even to suppress the perceived unevenness of the skin.

Furthermore, assume that a conventional brush whose tip surface is formed into a convex shape is used to take a cosmetic filled flat in the plate of its container, in which case areas near the center of the flat filled cosmetic decrease and form a concave shape and taking the cosmetic remaining at the bottom of the plate is difficult; when the cosmetic applicator 1 in the first embodiment is used, however, the cosmetic decreases roughly evenly from the top layer and consequently taking the cosmetic onto the brush is always easy.

It should be noted that, while the foregoing explanation assumed a fine solid powdery cosmetic, use of the cosmetic applicator proposed by the present invention is not at all limited to a solid powdery cosmetic and it can also be used with a powdery cosmetic in solution state prepared by dissolving a fine powder in water. Pour a powdery cosmetic in solution state into a flat plate in a cosmetic container and then move the cosmetic applicator back and forth multiple times to take up the cosmetic, and the cosmetic will be taken only onto the tips of bristle materials just like when a solid powdery cosmetic is taken up, and the amount of cosmetic taken onto the brush tip surface will become roughly even overall.

Then, with a roughly even amount of cosmetic taken across the brush tip surface 21, move the brush tip surface 21 back and forth over the face while keeping it in contact with the facial skin, and the many bristle materials constituting the brush tip surface 21 will be pressed against the skin with a roughly equivalent pressure as the cosmetic is applied. As a result, the cosmetic will be applied along the inverse cone shape of the brush tip surface 21, meaning that the cosmetic can be applied to the skin roughly evenly just like when a solid powdery cosmetic is used, while at the same time the cosmetic will be attached in an inverse cone shape relative to lines, pores and other uneven areas, which indicates that, by using the cosmetic applicator whose brush tip surface 21 has an inverse cone shape, the cosmetic can be applied in a manner not emphasizing such unevenness.

Furthermore, the cosmetic applicator proposed by the present invention has the core 11 in its handle part 10 and bristle materials are planted in the donut-shaped area between the core 11 and the interior surface of the handle part 10, which results in the planted bristle materials expanding in an inverse cone shape. As a result, the bristle material density does not increase even near the center axis of the brush part 20. This prevents a lot of powdery cosmetic from entering inside the brush through the bristle material surface near the center axis of the brush part 20 and hardening the areas near the center axis, and consequently a better feeling of use is achieved and more even application of cosmetic becomes possible.

Second Embodiment

FIG. 4 is a perspective view showing a second embodiment of a cosmetic applicator 1 pertaining to the present invention.

FIG. 5 is a section view of the cosmetic applicator 1 in the second embodiment, cut along plane A-A' as shown in FIG. 4.

The cosmetic applicator 1 in the second embodiment is different from the cosmetic applicator 1 in the first embodiment in that the gradually concaving shape is a curved surface 31, but it has the same constitution as the cosmetic applicator 1 in the first embodiment in all other aspects.

When the gradually concaving shape is the curved surface 31, the cosmetic can be taken only onto the tips of bristle materials and therefore the amount of cosmetic taken onto the brush tip surface 21 becomes roughly even overall.

Also because the brush tip surface 21 is a curved surface, the shape approximates the curved surfaces of facial areas in which the cosmetic is applied. Because of this, moving the brush tip surface 21 back and forth while keeping it in contact with the facial skin causes the many bristle materials constituting the brush tip surface 21 to be pressed against the skin with a roughly equivalent pressure as the cosmetic is applied. As a result, the cosmetic will be applied along the curved surface shape of the brush tip surface 21, meaning that the cosmetic can be applied to the skin roughly evenly, while at the same time the cosmetic will be attached in a curved surface shape relative to lines, pores and other uneven areas. This indicates that, by using the cosmetic applicator whose brush tip surface 21 has a curved surface shape, the cosmetic can be applied in a manner not emphasizing such unevenness.

Third Embodiment

FIG. 6 is a perspective view showing a third embodiment of a cosmetic applicator 1 pertaining to the present invention.

FIG. 7 is a section view of the cosmetic applicator 1 in the third embodiment, cut along plane A-A' as shown in FIG. 6.

The cosmetic applicator 1 in the third embodiment is different from the cosmetic applicators 1 in the first and second embodiments in that the gradually concaving shape is a stepped pattern 32, but it has the same constitution as the cosmetic applicators 1 in the first and second embodiments in all other aspects.

The cosmetic applicator 1 in the third embodiment is such that the tip surface 21 of the brush part is formed in a stepped pattern shape gradually concaving from the outer periphery 22 of the brush toward the center axis 23 (concentrically concave shape). The number of steps provided can be adjusted as deemed appropriate.

The cosmetic applicator in the third embodiment can achieve the same operations and effects as those of the first and second embodiments.

Fourth Embodiment

FIG. 8 is a side view showing a fourth embodiment of a cosmetic applicator 1 pertaining to the present invention.

FIG. 9 is a section view of the cosmetic applicator 1 in the fourth embodiment, cut along plane A-A as shown in FIG. 8.

The cosmetic applicator 1 in the fourth embodiment shares a common feature with the cosmetic applicators 1 in the first to third embodiments in that the tip of the brush part has a gradually concaving shape just like the cosmetic applicators 1 in the first to third embodiments, but as is evident from its section view in FIG. 9, the cosmetic applicator in the fourth embodiment has its handle part and brush part characterized by a non-circular cross-section shape. When this applicator is used, this shape allows for adjustment of the amount applied and pressure on the skin surface as the cosmetic is applied by moving the applicator in the lengthwise direction or widthwise direction of its cross-section.

As explained above, the cosmetic applicator 1 in the fourth embodiment differs in its section shape from the cosmetic applicators 1 in the first to third embodiments. Although not illustrated, the cosmetic applicator 1 in the fourth embodiment can also have a core 11 at the center, and the end of the core 11 may be fixed in a condition projecting toward the brush tip surface from the end of the handle part 10 on which the bristle materials are fixed, or the end of the core 11 may be kept within the end of the handle part 10, as is the case with the cosmetic applicators 1 in the first to third embodiments, and in particular, the effects of fixing the end of the core 11 in a condition projecting toward the brush tip surface from the end of the handle part are shared by the cosmetic applicators 1 in the first to third embodiments above. In addition, the size of the core 11 and its position with respect to the handle part are the same as with the cosmetic applicators 1 in the first to third embodiments.

Furthermore, with the cosmetic applicator 1 in the fourth embodiment, the cross-section of the cosmetic applicator is not limited to the shape shown in FIG. 9, but it may be an oval shape or quadrilateral or other polygonal shape, for example, so long as a core 11 can be provided at the center. Additionally, the core 11 may be a cylinder, or other column whose section is not a circle so long as the feeling of use of the cosmetic applicator is not degraded. Furthermore, in these cases, the outer periphery of the ring-shaped part of the present invention reflects the shape of the interior surface of the handle part, while the shape of the inner periphery reflects the outer periphery of the core 11.

The cosmetic applicator 1 in any of the first to fourth embodiments may be constructed with a powdery cosmetic loaded in the handle part. In this case, the powdery cosmetic may be loaded in the core 11 or a passage to externally supply the powdery cosmetic may be provided to the core 11. It is also possible to supply the powdery cosmetic by any desired means at the time of application through a discharge outlet for powdery cosmetic and by pressurizing a hollow elastic body provided at the handle part, for example, to supply air toward the end of the core on the brush tip side. The supplied powdery cosmetic travels through the center of the brush part 20 where the bristle material density happens to be low and is supplied to the brush tip.

Under the first to fourth embodiments, the brush part 20 is formed in a shape gradually concaving from the outer periphery 22 toward the center axis 23 of the brush part 20, and accordingly the cosmetic discharged to near the center axis 23 of the concave shape spreads along the concaving surface and consequently the amount of cosmetic taken up becomes roughly even roughly across the surface, and when the cosmetic is applied to the face in this condition, the cosmetic can be applied to the skin roughly evenly. Furthermore, any unevenness of the skin is less emphasized, lines, pores, etc., are made less conspicuous as a result.

In this case, the powdery cosmetic can be stored in the core 11 and handle part 10 beforehand.

As explained above, the cosmetic applicators 1 in the first to fourth embodiments have their brush part 20 formed in a shape gradually concaving from its outer periphery 22 toward the center axis 23 of the brush part 20, and therefore provide: a function to move the cosmetic roughly evenly to the brush tip surface 21; a function to apply and attach the cosmetic roughly evenly to the skin; and a function to make any unevenness of the skin less emphasized.

As mentioned earlier, the average particle sizes of cosmetics are becoming increasingly finer in recent years and, accordingly users are spending a long time using a cosmetic applicator to make up their faces in order to look more beautiful and make lines and other uneven areas less conspicuous.

The cosmetic applicators 1 in the first to fourth embodiments provide an easy way to apply cosmetics roughly evenly to the skin and make lines and other uneven areas less conspicuous, which helps achieve a makeup finish of a professional makeup artist without resorting to a very cumbersome makeup process or spending a long time.

For the concave shape of the cosmetic applicator, a desired shape can be selected according to the shape and area of the face, or specifically the size of the curved surface of facial skin. For example, selecting a concave shape that matches the convex shape of the surface of the face produces more prominent effects. It should also be noted that the concave shape of the cosmetic applicator is not at all limited to the three shapes mentioned above, and clearly includes any other shape that matches the technical idea of the cosmetic applicator proposed by the present invention.

On the other hand, cosmetic applicators whose handle part is loaded with a powdery cosmetic have been known. A discharge outlet of powdery cosmetic is provided at the center of the handle part of such cosmetic applicator, and the powdery cosmetic discharged from the discharge outlet travels through the center of the brush part whose tip surface is formed in a convex shape and reaches the tip surface. As a result, a large amount of cosmetic moves to near the center axis of the tip surface of the brush part, but because little cosmetic moves to the periphery, the cosmetic is not taken onto the brush tip surface roughly evenly, as is the case with the cosmetic brush described in Patent Literature 2 above, and consequently the brush is used to apply the cosmetic to the face in a condition where the cosmetic is taken only on its convex part.

Next, the method for manufacturing a cosmetic applicator pertaining to this embodiment is explained.

The cosmetic applicator pertaining to this embodiment is manufactured by forming the tip surface of the brush in a shape that gradually concaves from the outer periphery of the bush part toward the center axis.

A specific manufacturing method is explained below, but this manufacturing method is only one example and the present invention is not at all limited to this manufacturing method.

First, bristle materials are bundled and arranged according to the section shape of the handle part in which they will be implanted. The bristle materials may be bundled around a core on the fixing side. Then a convex object is pressed against one end of the bundled and arranged bristle materials to form a concave shape on this one end.

If a core is already fixed in the handle part, bristle materials are bundled around a molding core that contacts the core and whose section shape is the same as that of the core. Thereafter, the bundled bristle materials are put into the handle part together with the molding core so that they contact the core. In this condition, only the bristle materials are inserted and fixed in the ring-shaped part formed between the interior surface of the handle part and the exterior surface of the core, after which the molding core is removed in the fixing stage or after fixing.

This way, the other end of the bundled and arranged bristle materials is joined to the handle part to be implanted on, and the applicator is thus manufactured.

The convex object may be made of metal or resin, and any convex object matching the concave shape to be formed can be selected and used as deemed appropriate.

Means for joining the bristle materials include, for example, bonding with adhesive, as well as a method whereby the bristle materials having a concave shape formed on one end thereof are taken and their other end is pushed into one end of a hollow cylindrical handle part, and then the handle part is clinched together with the bristle materials that have been pushed inside, in order to join the bristle materials.

As explained above, the cosmetic applicator proposed by the present invention allows the cosmetic to be attached to the tip surface of the brush part roughly evenly, because the tip surface of the brush part is formed in a shape gradually concaving from the outer periphery of the brush part toward roughly the center.

In addition, the cosmetic applicator proposed by the present invention allows the cosmetic to be applied to desired areas of the skin, etc., roughly evenly, because the cosmetic is attached to the brush part roughly evenly, and this suppresses mottled appearance (thickness differences).

Furthermore, with the cosmetic applicator proposed by the present invention, the solid cosmetic in the container decreases roughly evenly, thus preventing the cosmetic from decreasing disproportionately in certain areas.

EXAMPLES

Example 1

A cosmetic attachment test was conducted using a cosmetic applicator of concave shape (inverse cone shape) formed according to the following dimensions: height of 25 mm from the tip of the handle part where the bristle materials are implanted to the very tip of the brush part; brush diameter of 35 mm at the very tip of the brush part; core diameter of 10 mm; height of 5 mm from the tip of the handle part to the end of the core on the brush tip side; brush diameter of 20 mm across the circle at the tip of the handle part where the bristle materials are implanted; and height of 3 mm from the very tip of the brush part to the deepest part of the concavity.

The cosmetic applicator was brushed back and forth twice against the flat surface of the cosmetic filled in its container to take up the cosmetic, after which the cosmetic applicator was brushed back and forth twice against the face over multiple areas in order to apply the cosmetic to the entire face by allowing it to attach to the skin.

When checked by three persons based on visual observation, the cosmetic had been attached roughly evenly on the brush tip surface and also inside the brush. Then, when the face was checked for the amount of cosmetic applied and condition of emphasis of unevenness, the cosmetic had been attached to the skin roughly evenly and no area was found where unevenness was emphasized.

Furthermore, the bristle material density did not increase at the center of the brush part at its very tip after continued use, and in particular, the very tip of the brush part did not harden because the cosmetic did not move to the center.

Comparative Example 1

A cosmetic attachment test was conducted using a cosmetic applicator of the following dimensions: height of 35 mm from the tip of the handle part where the bristle materials are implanted to the very tip of the brush part; brush diameter of 35 mm at the very tip of the brush part; brush diameter of 20 mm at the tip of the handle part where the bristle materials are implanted; and brush tip surface of roughly convex shape. No core was provided in the comparative example.

The test was conducted in the same manner as in Example 1 above, and when checked by three persons based on visual observation, a large amount of cosmetic had been taken onto the roughly convex part of the brush tip surface, where more cosmetic had been taken into the brush at the roughly convex part of the brush and the amount of cosmetic taken decreased toward the outer periphery. Then, when the face was checked for the amount of cosmetic applied and condition of emphasis of unevenness, the cosmetic had been attached to the skin unevenly and mottled appearance had resulted, and multiple areas were found where unevenness was emphasized.

Comparative Example 2

A cosmetic applicator was created in the same manner as in Example 1, except that no core was provided, and the same test was conducted.

The results found that, although there was no mottled appearance caused by uneven attachment to the skin or no multiple areas where unevenness was emphasized, unlike in Comparative Example 1, the brush hardened with use because the cosmetic moved to the tip of the brush, and this compromised the good feeling of use and made it difficult to apply the cosmetic evenly.

The invention claimed is:

1. A cosmetic applicator comprising a handle part and a brush part made of bristle materials planted in the handle part and which is used to apply a powdery cosmetic containing a fine powder, said cosmetic applicator characterized in that the bristle materials are planted in a ring-shaped part formed between an interior surface of the handle part and an exterior surface of a core provided in the handle part, and the bristle materials of the brush part extend upward from the handle part and their tips form an outer periphery having a horizontal shape relative to the handle part, while forming a shape gradually concaving from the outer periphery toward a center axis of the brush part, wherein the core is cylindrical and has a first end extending from the handle part and an opposed free second end, the diameter of the core being uniform along its length from the first to the second end thereof, wherein the exterior surface of the core extends and projects toward a tip of the brush part with reference to an upper end of the handle part, constituting a projecting extra exterior cylindrical surface of the core which contacts and supports the bristle material beyond the upper end of the handle part, and wherein a height from the upper end of the handle part to a tip of the exterior cylindrical surface at the second end of the core is 3 to 10 mm.

2. A cosmetic applicator according to claim 1, characterized in that the concave shape is an inverse cone.

3. A cosmetic applicator according to claim 2, characterized in that a concave factor of the concave shape is 0.05 to 0.3.

4. A cosmetic applicator according to claim 1, characterized in that the concave shape is a curved surface.

5. A cosmetic applicator according to claim 4, characterized in that a concave factor of the concave shape is 0.05 to 0.3.

6. A cosmetic applicator according to claim 1, characterized in that the concave shape is a stepped pattern.

7. A cosmetic applicator according to claim 6, characterized in that a concave factor of the concave shape is 0.05 to 0.3.

8. A cosmetic applicator according to claim 1, characterized in that a concave factor of the concave shape is 0.05 to 0.3.

9. A cosmetic applicator according to claim 1, wherein a height from the upper end of the handle part to a tip of an outer part of the brush part is 25 mm.

10. A method for manufacturing a cosmetic applicator comprising a handle part and a brush part made of bristle materials planted in the handle part and which is used to apply a cosmetic, said method for manufacturing a cosmetic applicator characterized in that the bristle materials are planted in a ring-shaped part formed between an interior surface of the handle part and an exterior cylindrical surface of a core provided in the handle part, and a tip surface of the brush part is formed in a shape gradually concaving from an outer periphery of the brush part toward a center axis of the brush part, wherein the core is cylindrical and has a first end extending from the handle part and an opposed free second end, the diameter of the core being uniform along its length from the first to the second end thereof, wherein the exterior surface of the core extends and projects toward a tip of the brush part with reference to an upper end of the handle part, constituting a projecting extra exterior cylindrical surface of the core which contacts and supports the bristle material beyond the upper end of the handle part, and wherein a height from the upper end of the handle part to a tip of the exterior cylindrical surface at the second end of the core is 3 to 10 mm.

* * * * *